US006111349A

United States Patent [19]

Kuwana et al.

[11] Patent Number: 6,111,349

[45] Date of Patent: Aug. 29, 2000

[54] APERTURE GRILLE STRUCTURE FOR A CATHODE RAY TUBE

[75] Inventors: Yasuhiro Kuwana; Masaaki Kamei, both of Greensburg, Pa.

[73] Assignees: Sony Corporation, Tokyo, Japan; Sony Electronics Inc., Park Ridge, N.J.

[21] Appl. No.: 09/139,550

[22] Filed: Aug. 25, 1998

[51] Int. Cl.[7] ..... H01J 29/80

[52] U.S. Cl. ..... 313/407; 313/404; 445/30

[58] Field of Search ..... 313/402, 404, 313/407; 445/30, 37

[56] References Cited

U.S. PATENT DOCUMENTS

| | | | |
|---|---|---|---|
| 4,333,034 | 6/1982 | Ohgoshi et al. | 313/407 |
| 5,554,909 | 9/1996 | Brennesholtz | 313/402 |
| 5,610,473 | 3/1997 | Yokota et al. | 313/402 |
| 5,686,784 | 11/1997 | Thoms et al. | 313/402 |
| 5,801,479 | 9/1998 | Shinoda | 313/402 |

*Primary Examiner*—Michael H. Day

[57] ABSTRACT

An aperture grille for cathode ray tube which includes a frame having at least one cutout portion. The aperture grille further includes a color screening electrode having a plurality of grille tapes which are held in tension in the frame thus causing at least one stress level in an associated region of the frame. The cutout portion is positioned adjacent the region so as to reduce the stress level.

15 Claims, 7 Drawing Sheets

APERTURE GRILLE STRUCTURE FOR A CATHODE RAY TUBE

FIELD OF THE INVENTION

The present invention relates to cathode ray tubes (CRTs), and more particularly, to a CRT having an aperture grille structure which includes a cutout that reduces stresses in selected regions of the aperture grille structure so as to reduce wrinkling of grille tapes.

BACKGROUND OF THE INVENTION

A cathode ray tube is frequently used to generate images for displays such as televisions (TVS), computer monitors and others. Referring to FIG. 1, an example of a CRT 10 used in Trinitron (trademark) TVS and monitors manufactured by SONY Corporation is shown. The CRT 10 includes an enclosure or tube 12 which houses a color selecting mechanism known as an aperture grille 14 (partially shown for purposes of clarity). The tube 12 includes a front panel 16 having an inner surface which has been coated with phosphor strips arranged in a stripe configuration suitable for providing a color image. The aperture grille 14 is positioned adjacent the inner surface and opposite an electron gun having a cathode assembly 18, prefocusing 20 and main focusing 22 electron lenses, and a convergence deflector 24. In operation, three primary color (red, green, blue) electron beams 26 are emitted from the cathode assembly 18. The electron beams 26 are then converged onto a center axis of the CRT 10 by the prefocusing 20 and main focusing 22 electron lenses. The electron beams 26 then emerge along divergent paths and are deflected by the convergence deflector 24 to converge on the aperture grille 14 so as to form stripes 28 used for forming color images on the front panel 16.

Referring to FIG. 2, a perspective view of the aperture grille 14 is shown. The aperture grille 14 includes a frame 30 which supports a color screening electrode 33 (partially shown for purposes of clarity). The frame 30, which may be fabricated from a resilient material such as steel, includes a first attachment arm 32 which includes a first upright portion 34 having first 36 and second 38 ends and a first bottom edge 37. The frame 30 also includes a second attachment arm 40 which includes a second upright portion 42 having third 44 and fourth 46 ends and a second bottom edge 45. The first 32 and second 40 attachment arms further include first 48 and second 50 base portions, respectively, to form a substantially L-shaped configuration. In addition, the frame 30 includes substantially U-shaped first 52 and second 54 support arms each having first 56 and second 58 support ends. The first 56 and second 58 support ends are attached, typically by welding, to the first 48 and second 50 base portions, respectively, such that the first 32 and second 40 attachment arms and the first 52 and second 54 support arms form a substantially rectangular configuration. Specifically, a first attachment interface 200 is created between the first support end 56 of the first support arm 52 and the first bottom edge 37 of the first base portion 48 of the first attachment arm 32. A second attachment interface 210 is created between the first support end 56 of the second support arm 54 and the first bottom edge 37 of the first base portion 48 of the first attachment arm 32. A third attachment interface is 220 is created between the second support end 58 of the first support arm 52 and the second bottom edge 45 of the second base portion 50 of the second attachment arm 40. A fourth attachment interface 230 is created between the second support end 58 of the second support arm 54 and the second bottom edge 45 of the second base portion 50 of the second attachment arm 40. Typically, the first 34 and second 42 upright portions and the first 48 and second 50 base portions are each 5–7 mm thick.

The color screening electrode 33 includes first 60 and second 62 border portions and a plurality of stripe shaped slits 64 oriented in a substantially parallel configuration. The slits 64 are made by etching elongated sections of a thin sheet of metal to form a plurality of grille tapes 66 which extend between the first 60 and second 62 border portions. In use, the grille tapes 66 are oriented substantially vertically within the CRT 10 such that the electron beams 26 pass through the slits 64 and strike appropriate phosphor strips on the inner surface so as to form a desired color image.

In order to assemble the color screening electrode 33 to the frame 30, pressure is applied to the frame 33 so as to cause the first 32 and second 40 attachment arms to move inward and toward each other. Further, the color screening electrode 33 is stretched such that the grille tapes 66 are taut. The first 60 and second 62 border portions of the color screening electrode 33 are then attached, by welding for example, to the first 32 and second 40 attachment arms, respectively. The pressure on the frame 30 is then released, which causes the resiliency of the frame 30 to urge the first 32 and second 40 attachment arms back to their original position. This places the grille tapes 66 in tension between the first 60 and second 62 border portions, which serves to reduce vibration of the grille tapes 66. Such vibrations are undesirable since they cause misalignments between the electron beams 26 and the phosphor strips, resulting in a degradation of image quality. By way of example, such vibrations may be caused by external forces such as those generated by sound emitted from a speaker attached to a display.

Referring to back FIG. 2, another method utilized for reducing vibration of the grille tapes 66 includes the use of a damper wire 64. The damper wire 64 is stretched across the grille tapes 66 in a transverse direction such that the damper wire 64 contacts and clamps down on the grille tapes 66. By way of example, the damper wire 64 may be fabricated from tungsten and have a diameter of approximately 20 $\mu$m. Further, one or more damper wires may be used depending on the size of the color screening electrode 33. A damper wire may be used to reduce vibrations in a CRT having an arcuately shaped front panel, wherein the color screening electrode is also arcuately shaped, or in a flat display CRT, wherein the front panel and thus the color screening electrode are relatively flat. As such, the clamping force exerted by the damper wire on the grille tapes is greater in arcuately shaped CRTs wherein the damper wire is stretched across an arcuately shaped color screening electrode than in a flat display CRT wherein the damper wire is stretched across a relatively flat color screening electrode.

Frequently, nonuniformities known as wrinkles occur in sections of the grille tapes 66 upon completion of the assembly process. Such wrinkles result in undesirable positioning and orientation of the grille tapes 66, thus causing a degradation of image quality. In arcuately shaped CRTs, the damper wire 64 typically exerts a clamping force sufficient to reduce the amount of wrinkling. However, this is only effective in areas wherein the damper wire 64 actually contacts the grille tapes 66. Further, in flat display CRTs having relatively flat color screening electrodes, the clamping force produced by the damper wire 64 is substantially smaller. As a result, the damper wire 64 in these displays are relatively ineffective in reducing the amount of wrinkling of the grille tapes 66.

SUMMARY OF THE INVENTION

An aperture grille for a cathode ray tube is disclosed having a frame which includes at least one cutout portion. The aperture grille further includes a color screening electrode having a plurality of grille tapes which are held in tension in the frame thus causing at least one stress level in an associated region of the frame. The cutout portion is positioned adjacent the region so as to reduce the stress level in the region and reduce the size of wrinkles in the grille tapes.

The features of the invention believed to be novel are set forth with particularity in the appended claims. The invention itself however, both as to organization and method of operation, together with further objects and advantages thereof, may be best understood by reference to the following description taken in conjunction with the accompanying drawing.

DETAILED DESCRIPTION OF THE INVENTION

Figure 1:
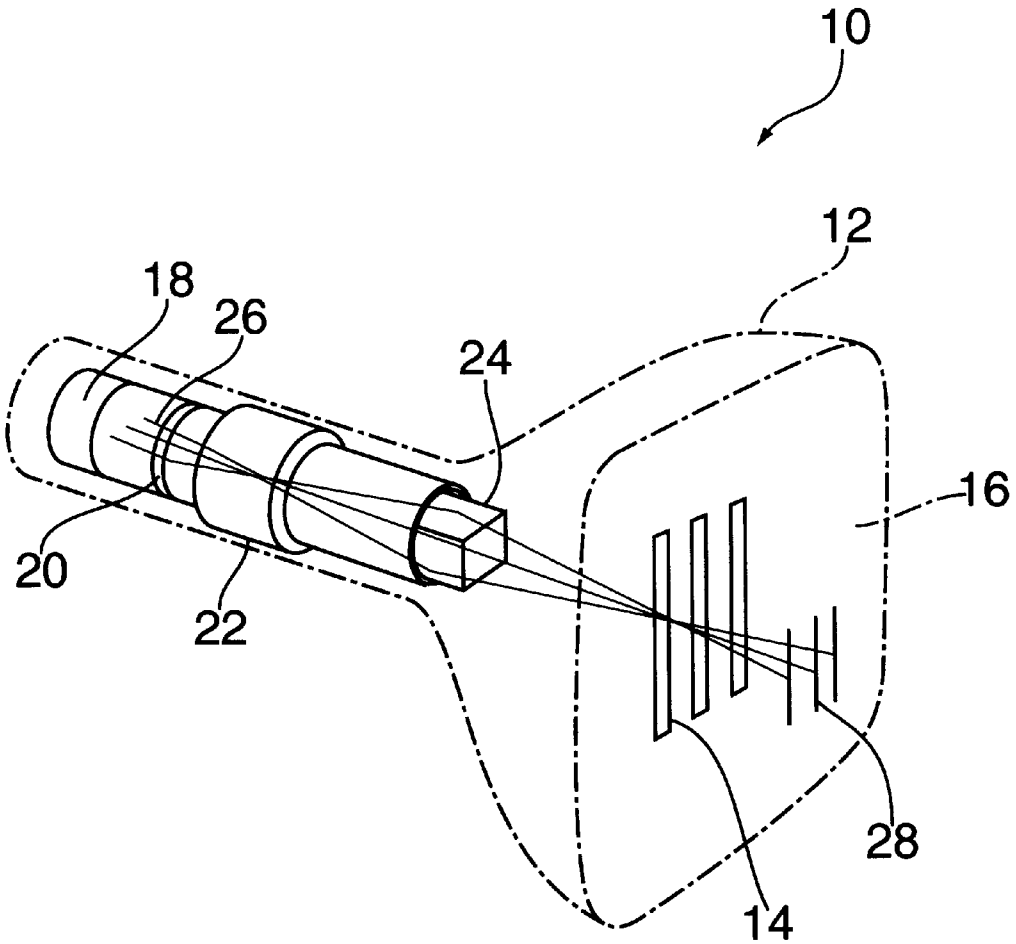
FIG. 1 PRIOR ART
FIG. 1 is an illustrative view of a cathode ray tube used in Trinitron (trademark) TV or monitor manufactured by the SONY Corporation.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of the drawing.

Figure 2:
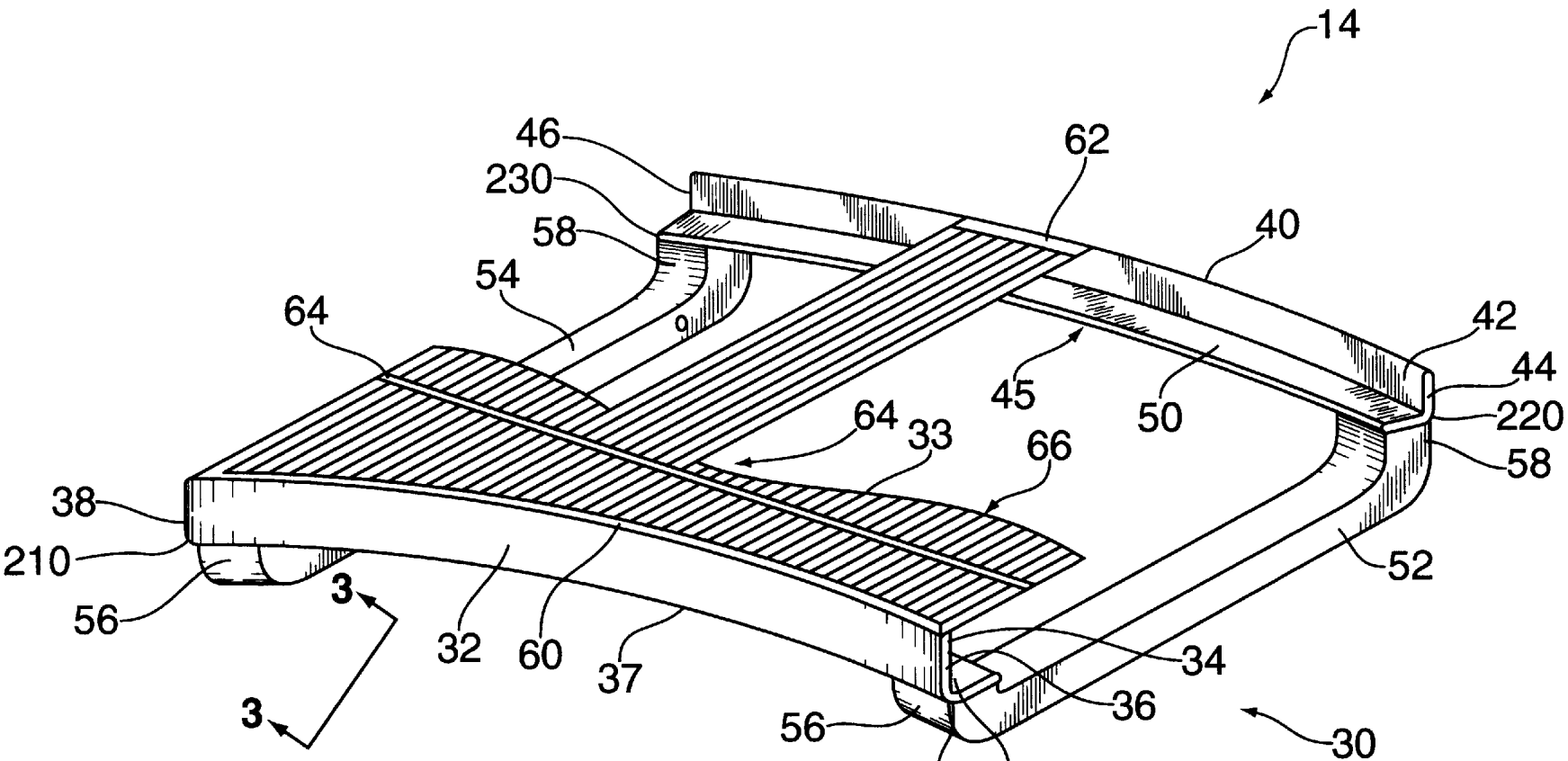
FIG. 2 PRIOR ART
FIG. 2 is a perspective view of a conventional aperture grille is shown.
Figure 3:
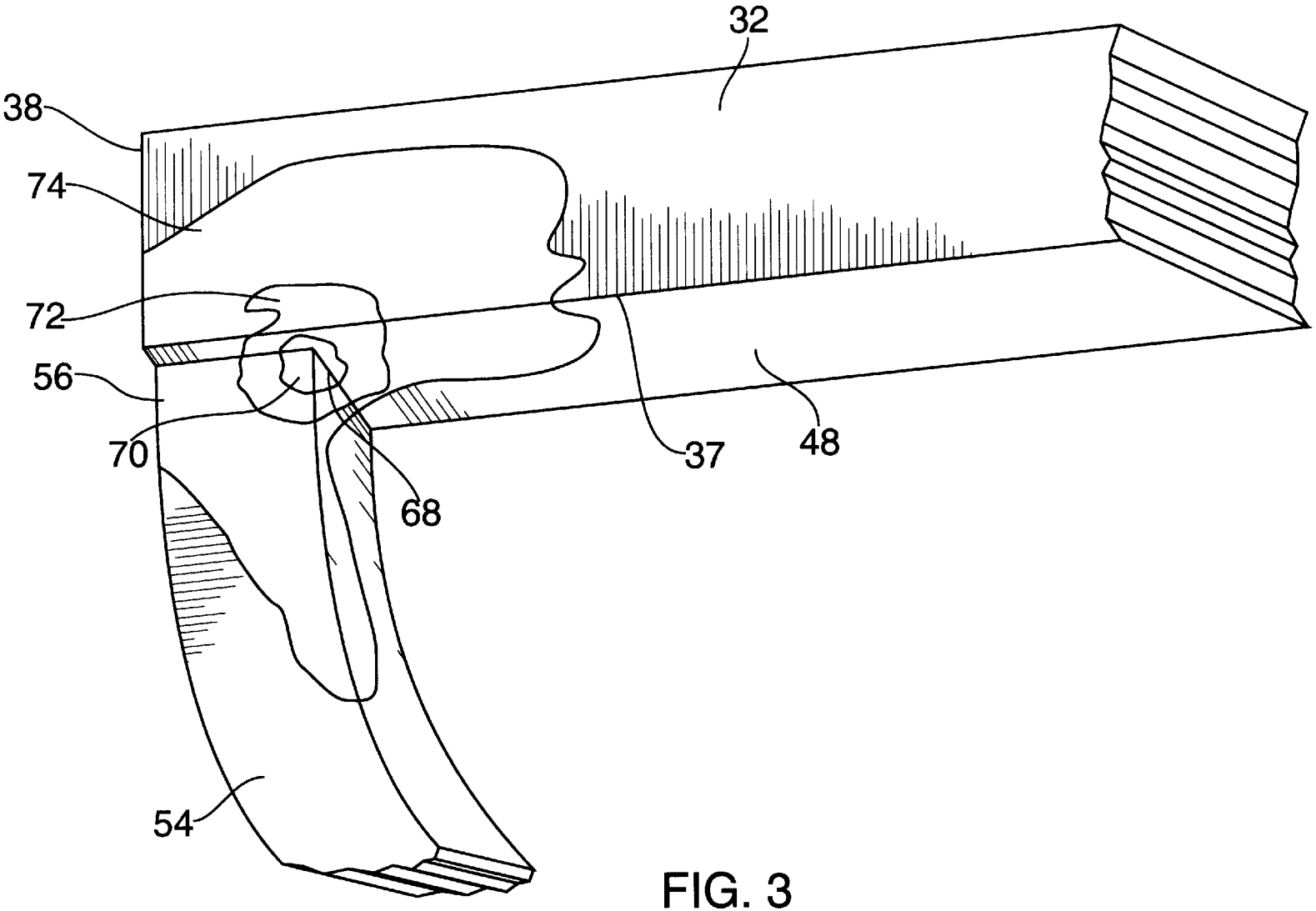
FIG. 3 is a view of a comer of a frame along view line 3—3 of FIG. 2 and illustrates some of the stress levels which occur in a frame.

It has been found that nonuniform stresses are generated in the frame 30 upon attachment of the color screening electrode 33 to the frame 30. Further, depending on the region of the frame 30, the stresses range between the elastic and plastic deformation areas for the frame material. In particular, relatively high stress concentrations occur in the frame 30 in the vicinity of the weld joints which join the first 48 and second 50 base portions to the first 56 and second 58 support ends. Referring to FIG. 3, a comer of the frame 30 along view line 3—3 of FIG. 2 is shown which depicts an area wherein the first support end 56 of the second support arm 54 is attached to the first base portion 48 of the first attachment arm 32. Through computer aided finite element stress analysis, it has been found that at least three levels of stress occur in this area. The highest stress level, which is in the range of 70–200 kg/mm$^2$, occurs in an area depicted generally as first area 70 which includes sections of an inner interface 68 between the first support end 56 of the second support arm 54 and the first base portion 48 of the first attachment arm 32. In addition, a second stress level in the range of 50–70 kg/mm$^2$ occurs in an area depicted generally as second area 72 which surrounds the first area 70 and includes portions of the first support end 56 and the first base portion 48. Further, the lowest stress level, which is in the range of 25–50 kg/mm$^2$, occurs in an area depicted generally as third area 74 which surrounds the second area 72. The point at which plastic deformation for the frame material begins, i.e. the breakdown point, is approximately 60 kg/mm$^2$. As such, the stress levels which occur in the first area 70 exceed the breakdown point. Further, it is noted that the stress level found in the second area 72 may also exceed the breakdown point for the frame material depending on the actual stress level value.

After assembly, a blackening process is performed which causes the formation of a black film on both the frame 30 and the color screening electrode 33 which serves to reduce reflections in the CRT 10. The blackening process also provides an annealing effect that reduces stress levels in the frame 30. However, it has been found that the stress levels in the first 70 and second 72 areas are not reduced as much as in other regions of the frame 30, thus further increasing the difference in stress levels between regions of the frame 30. Further, the difference in stress levels is such that substantial nonuniform distortions occur in the frame 30. Such nonuniform distortions may occur, for example, due to some regions being subjected to stress levels which are within the elastic deformation area for the frame material whereas other regions are subjected to stress levels which are within the plastic deformation area. As a result, sections of the grille tapes 66 are no longer held substantially taut between the first 60 and second 62 border portions, which results in the formation of wrinkles in the grille tapes 66. Further, it has been found that wrinkles which are greater than 20 $\mu$m in size (i.e. displacement from normal grille tape position) degrade image quality to an unacceptable level.

Figure 4:
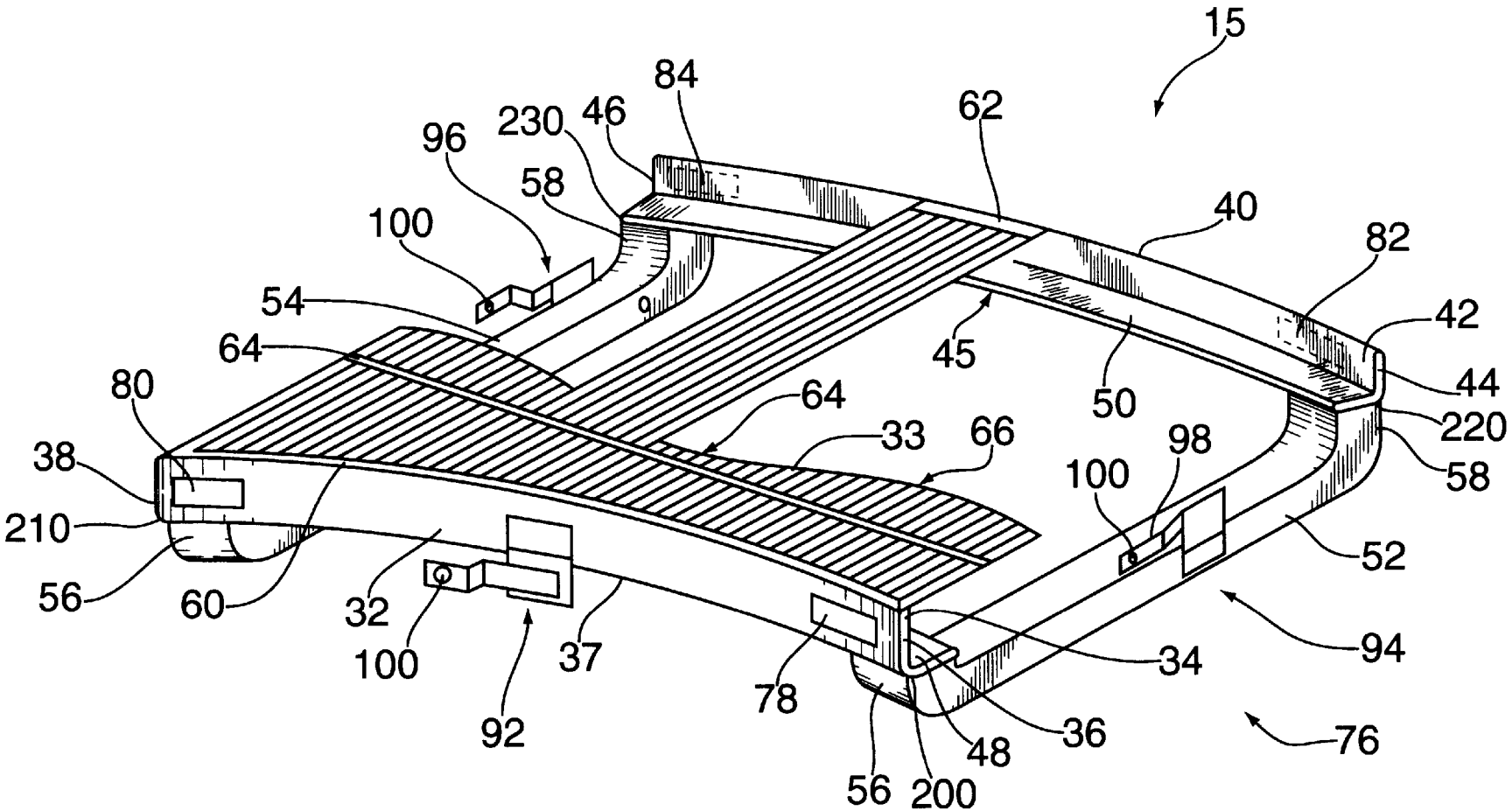
FIG. 4 is a perspective view of an aperture grille which includes cutout portions in accordance with the present invention.

Referring to FIG. 4, an aperture grille 15 having a frame 76 and color screening electrode 33 in accordance with the present invention is shown. It has been found that the removal of material from the first 32 and second 40 attachment arms in a location adjacent the first 56 and second 58 support ends of both the first 32 and second 40 attachment arms substantially reduces the stress levels in the first 70 and second 72 areas (FIG. 3). This results in more uniform frame distortions and thus reduces the size of the wrinkles in the grille tapes 66 of the color screening electrode 33 to an acceptable level. In one embodiment, the first upright portion 34 includes first 78 and second 80 cutout portions which are formed adjacent to the first support ends 56 of both the first 52 and second 54 support arms, respectively. In addition, the second upright portion 42 includes third 82 and fourth 84 cutout portions (shown as dashed lines) which are formed adjacent to the second support ends 56 of both the first 52 and second 54 support arms, respectively. The first 78, second 80, third 82 and fourth 84 cutout portions may be formed by removing material to form a cutout which extends partially into the first 34 and second 42 upright portions. Alternatively, the first 34 and second 42 upright portions may be manufactured with the first 78, second 80, third 82 and fourth 84 cutout portions already formed therein.

Figure 5A:
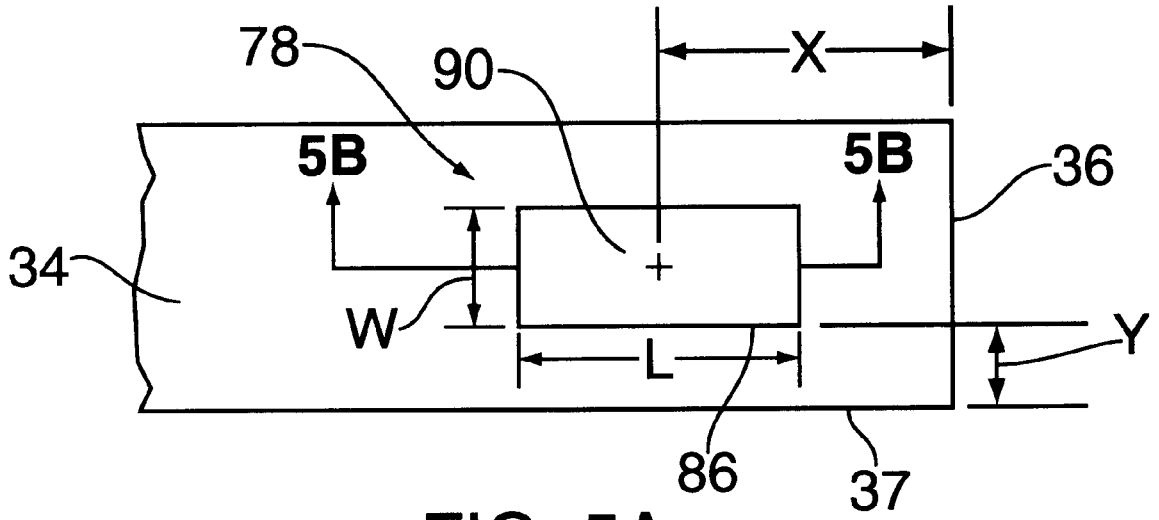
FIGS. 5A and 5B depict a configuration for an exemplary cutout portion.
Figure 5B:
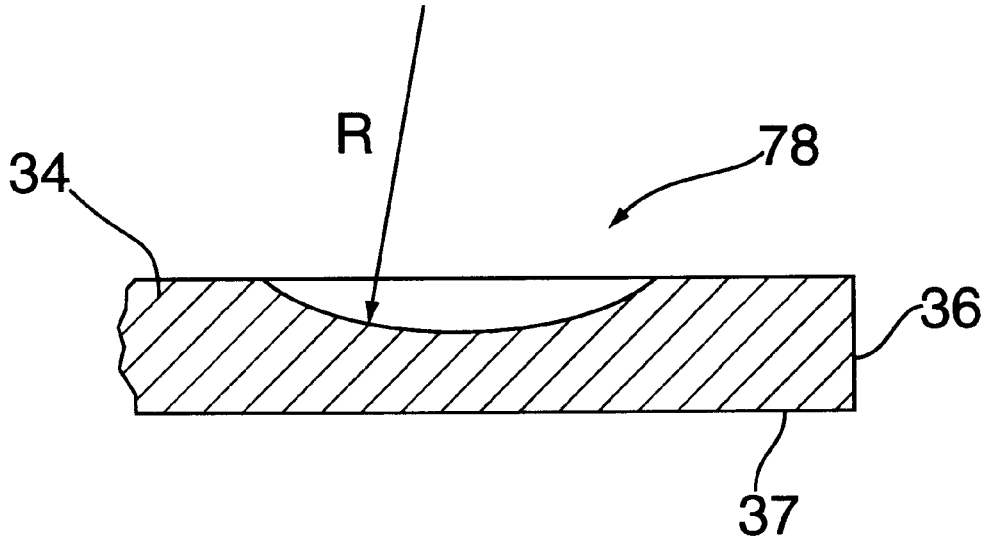

Referring to FIG. 5A, a front view of the first cutout portion 78 is shown. The first cutout portion 78 is defined by a length L and width W and has a substantially rectangular shape. A cutout edge 86 of the first cutout portion 78 is located a first distance Y from the first bottom edge 37. Further, a center 90 of the first cutout portion 78 is separated from the first end 36 by a second distance X such that the first cutout portion 78 is located adjacent the first support end 56 of the first support arm 52 to thus reduce stress levels adjacent to the interface between the first support end 56 and the first base portion 48. Referring to FIG. 5B, a cross sectional view of the first cutout portion 78 along sectional line 5B—5B is shown. A depth of the first cutout portion 78 is defined by a radius R and is substantially arc shaped.

The second 80, third 82 and fourth 84 cutout portions are identical in configuration and size to the first cutout portion 78 and are similarly located relative to the second 38, third 44 and fourth 46 ends and the first 37 and second 45 bottom edges. In particular, centers of the second 80, third 82 and fourth 84 cutout portions are separated from the second 38, third 44 and fourth 46 ends, respectively, by the second distance X. In addition, the cutout edge of the second cutout portion 80 is separated from the first bottom edge 37 by the first distance Y. Further, the cutout edges of the third 82 and fourth 84 cutout portions are separated from the second bottom edge 45 by the first distance Y. As such, the second 80, third 82 and fourth 84 cutout portions are located adjacent the first support end 56 of the second support arm 54 and the second support ends 58 of the first 52 and second 54 support arms, respectively, to thus reduce stress levels.

In one embodiment, the L, W, Y, X and R dimensions for the first 78, second 80, third 82 and fourth 84 cutout portions are approximately 30.4 mm, 11 mm, 13 mm, 29.5 mm and 40 mm, respectively, although it is noted that other dimensions suitable for reducing wrinkle size may be used depending on frame size and other considerations. In this regard, it is noted that the principles of this invention are applicable to 36 inch or larger TVS which have either arcuately shaped or flat displays. Alternatively, some or all of the first 78, second 80, third 82 and fourth 84 cutout portions may differ from each other in size, configuration and\or location on the frame 76.

Figure 6A:
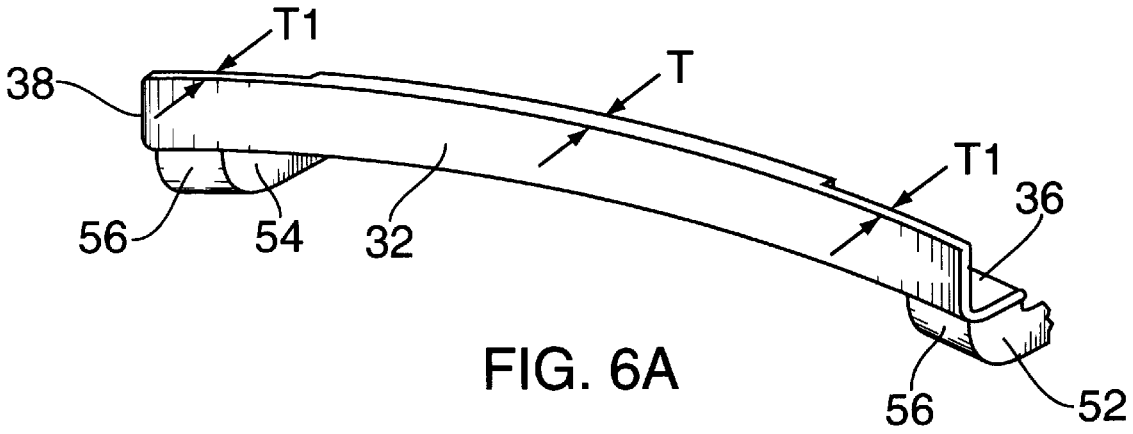
FIGS. 6A and 6B depict alternate techniques for removing material in order to reduce wrinkle size.
Figure 6B:
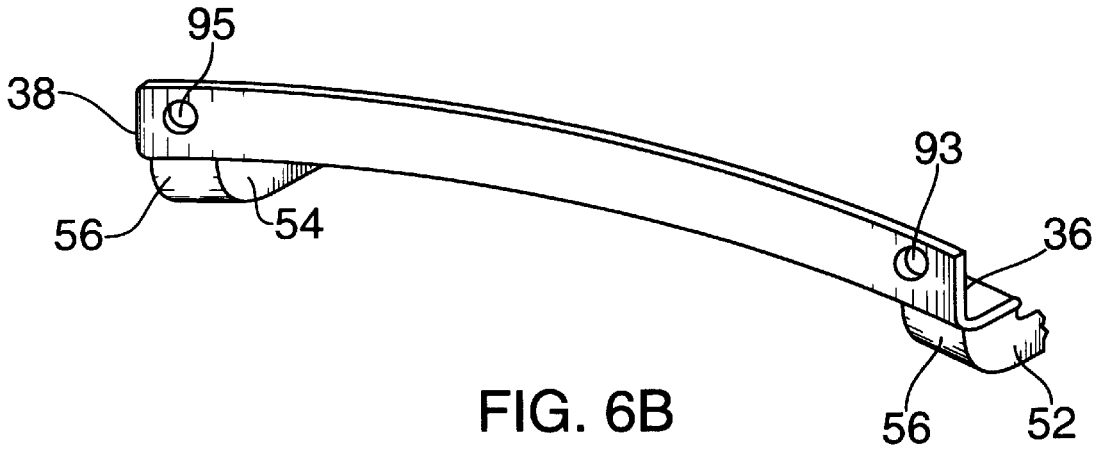

Referring to FIGS. 6A and 6B, alternate techniques for removing material in order to reduce wrinkle size are shown. In FIGS. 6A and 6B, the alternate techniques are described in relation to the first attachment arm 32, although it is understood that the alternate techniques are also applicable to the second attachment arm 40. Referring to FIG. 6A, material is removed from the first attachment arm 32 by reducing a first thickness T of the first upright portion 34 to a second thickness T1 in a location adjacent the first 56 and second 58 support ends. Referring to FIG. 6B, material is removed from the first attachment arm 32 by forming first 93 and second 95 holes in the first upright portion 34 in a location adjacent the first 56 and second 58 support ends. Alternatively, it is noted that a combination of the techniques described in FIGS. 4, 5A, 5B, 6A and 6B may be used on either or both of the first 32 and second 40 attachment arms.

Figure 7:
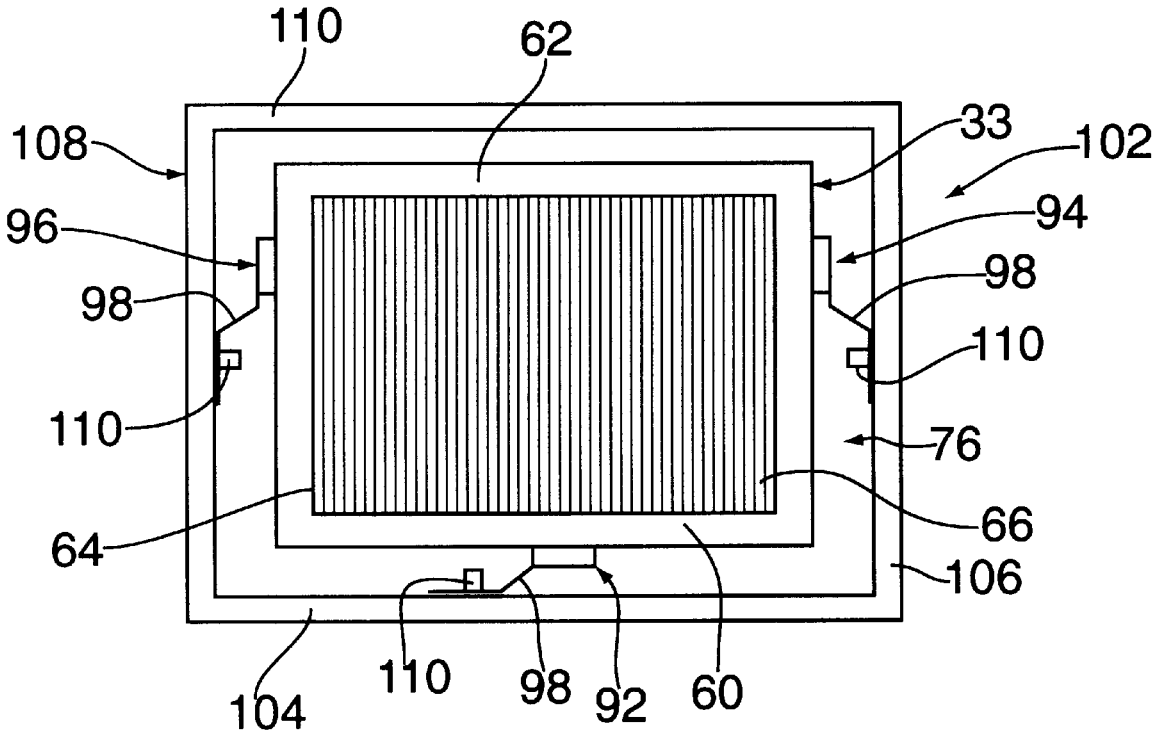
FIG. 7 illustrates the aperture grille being positioned within a CRT panel.
Figure 8:
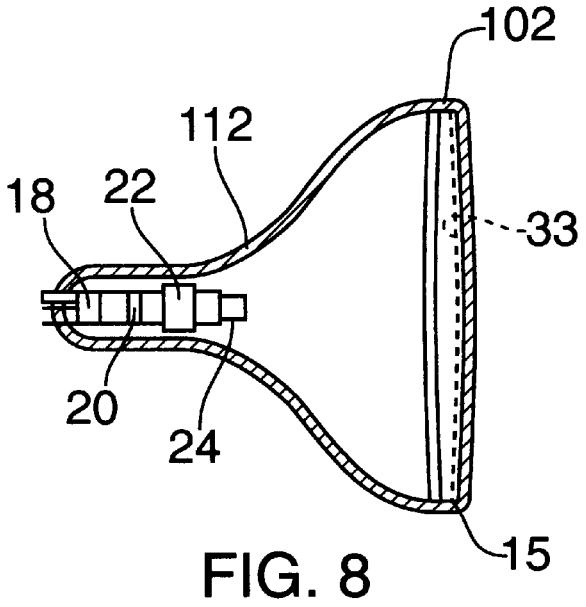
FIG. 8 is a view of a CRT which includes the aperture grille of the present invention.

Referring back to FIG. 4, the frame 76 further includes first 92, second 94 and third 96 spring elements which are welded to the first attachment arm 32 and the first 52 and second 54 support arms, respectively. The first 92, second 94 and third 96 spring elements each include a projecting spring member 98 having a pin aperture 100. Referring to FIG. 7 in conjunction with FIG. 4, a CRT panel 102 for receiving the frame 76, and thus color screening electrode 33, is shown. The CRT panel 102 includes first 104, second 106, third 108 and fourth 10 skirt sections that form a substantially rectangular configuration which is sized to accept the frame 76. The first 104, second 106 and third 108 skirt sections each include a panel pin 110 which is adapted to be inserted into the pin aperture 100 located on the projecting spring member 98 of the first 92, second 94 and third 96 spring elements, respectively. Upon insertion of the each panel pin 110 into its associated pin aperture 100, the frame 76 is thus suspended within the CRT panel 102. Referring to FIG. 8, the CRT panel 102, which now includes the aperture grille 15 having the frame 76 (not shown for purposes of clarity) and color screening electrode 33, is then attached to an enclosure 112 which includes the cathode assembly 18, prefocusing 20 and main focusing 22 electron lenses, convergence deflector 24 and other associated elements for forming a CRT for use in a Trinitron (trademark) TV or monitor.

Thus it is apparent that in accordance with the present invention, an apparatus that fully satisfies the objectives, aims and advantages is set forth above. While the invention has been described in conjunction with specific embodiments, it is evident that many alternatives, modifications, permutations and variations will become apparent to those skilled in the art in light of the foregoing description. For example, while the present invention is described in relation to a color CRT such as that designated as CRT 38 RSN, it is understood that this invention is equally applicable to other CRT apparatus. Accordingly, it is intended that the present invention embrace all such alternatives, modifications and variations as fall within the scope of the appended claims.

What is claimed is:

1. An aperture grill for a cathode ray tube, comprising:

a frame having first and second attachment arms which are attached to first and second support arms, said first and second attachment arms each including at least one cutout portion; and a color screening electrode having a plurality of grille tapes which are held in tension between said first and second attachment arms thus causing a plurality of stress levels in regions of said frame which cause wrinkles in said grille tapes, wherein said cutout portion is positioned adjacent said regions to reduce said stress levels in said regions and thus said wrinkles, wherein said cutout portions in said first and second attachment arms are substantially rectangular and do not extend into said first and second support arms.

2. The aperture grille according to claim 1, wherein said cutout portion extends partially into said frame.

3. The aperture grille according to claim 1, wherein said cutout portion is a hole which extends through said frame.

4. The aperture grille according to claim 1, wherein said cutout portion includes reducing a thickness of a section of said frame.

5. The aperture grille according to claim 1, wherein said wrinkles are reduced to a size of 20 $\mu$m or less.

6. An aperture grill, for a cathode ray tube, comprising:

first and second attachment arms which are substantially parallel to each other;

first and second support arms which are oriented in a direction traverse to said first and second attachment arms and which are substantially parallel to each other, wherein support ends of said first and second support arms are attached to attachment ends of said first and second attachment arms to form a frame having substantially rectangular configuration which includes first, second, third and fourth attachment interfaces, said first attachment arm having first and second cutout portions and said second attachment arm having third and fourth cutout portion; and a color screening electrode having a plurality of substantially parallel grille tapes which are held in tension between said first and second attachment arms thus causing a plurality of stress levels in regions of said frame which are adjacent said first, second, third and fourth attachment interfaces, wherein said stress levels cause nonuniform distortions in said frame which result in the formation of undesirable wrinkles which are greater than 20 μm in size in said grille tapes and wherein said first, second, third and fourth cutout portions are located adjacent said first, second, third and fourth attachment interfaces to reduce stress levels near said first, second, third and fourth attachment interfaces and thus the size of said wrinkles to 20 μm or less, wherein said first, second, third and fourth cutout portions in said first and second attachment arms are substantially rectangular and do not extend into said first and second support arms.

7. The aperture grille according to claim 6, wherein said cutout portion is a hole which extends through said frame.

8. The aperture grille according to claim 6, wherein said cutout portion includes reducing a thickness of section of said frame.

9. The aperture grille according to claim 6, wherein said first and second attachment arms are fabricated from steel.

10. An aperture grill, for a cathode ray tube, comprising:

first and second attachment arms which are substantially parallel to each other;

first and second support arms which are oriented in a direction traverse to said first and second attachment arms and which are substantially parallel to each other, wherein support ends of said first and second support arms are attached to attachment ends of said first and second attachment arms to form a frame having substantially rectangular configuration which includes first, second, third and fourth attachment interfaces, said first attachment arm having first and second cutout portions and said second attachment arm having third and fourth cutout portion; and a color screening electrode having a plurality of substantially parallel grille tapes which are held in tension between said first and second attachment arms thus causing a plurality of stress levels in regions of said frame which are adjacent said first, second, third and fourth attachment interfaces, wherein said stress levels cause nonuniform distortions in said frame which result in the formation of undesirable wrinkles which are greater than 20 μm in size in said grille tapes and wherein said first, second, third and fourth cutout portions are located adjacent said first, second, third and fourth attachment interfaces to reduce stress levels near said first, second, third and fourth attachment interfaces and thus the size of said wrinkles to 20 μm or less, wherein said first, second, third and fourth cutout portions are rectangularly shaped each having a length of approximately 30.4 mm, a width of approximately 11 mm and a depth defined by a radius of approximately 40 mm.

11. The aperture grille according to claim 10, wherein a first cutout edge of said first, and second cutout portions is located approximately 13 mm from a first bottom edge of said first attachment arm and a second cutout edge of said third and fourth cutout portions is located 13 mm from a second bottom edge of said second attachment arm.

12. The aperture grille according to claim 11, wherein centers of said first and third cutout portions are located approximately 29.5 mm from said first and second attachment ends of said first attachment arm and centers of said second and fourth cutout portions are located approximately 29.5 mm from said first and second attachment ends of said second attachment arm.

13. A cathode ray tube, comprising:

a cathode assembly for providing primary color electron beams;

prefocusing and main focusing electron lenses, wherein said lenses converge said electron beams onto a center axis;

a convergence deflector;

a tube for holding said cathode assembly, said prefocusing lense, said main focusing lense and said convergence deflector, said tube having a front panel which includes an inner surface that is coated with a luminous material;

an aperture grille positioned adjacent said inner surface, said aperture grille having a frame having first and second attachment arms which are attached to first and second support arms, said first and second attachment arms including at least one cutout portion;

a color screening electrode having a plurality of grille tapes which are held in tension in said frame thus causing at least one stress level in an associated region of said frame, wherein said cutout portion is positioned adjacent said region to reduce said stress level, wherein said convergence deflector deflects said electron beams onto said color screening electrode in order to form images on said front panel, wherein said at least one cutout portion in said first and second attachment arms are substantially rectangular and do not extend into said first and second support arms.

14. A method for reducing wrinkles in an aperture grille for a cathode ray tube, comprising the steps of:

providing a frame having first and second attachment arms which are attached to first and second support arms, said first and second attachment arms having at least one cutout portion;

providing a color screening electrode having a plurality of grille tapes which are held in tension in said frame thus causing at least one stress level in an associated region of said frame; and positioning said at least one cutout portion adjacent said region to reduce said stress level wherein said at least one cutout portion in said first and second attachment arms are substantially rectangular and do not extend into said first and second support arms.

15. A method for providing an image, comprising the steps of:

providing primary color electron beams;

focusing said electron beam onto a center axis;

providing a tube having a front panel which includes an inner surface that is coated with luminous material;

providing an aperture grille adjacent said inner surface, said aperture grille having a frame having first and second attachment arms which are attached to first and second support arms, said first and second attachment arms including at least one cutout portion;

providing a color screening electrode having a plurality of grille tapes which are held in tension in said frame thus causing at least one stress level in an associated region of said frame;

positioning said cutout portion adjacent said region to reduce said stress level; and deflecting said electron beams onto said color screening electrode in order to form images on said front panel, wherein said at least one cutout portion in said first and second attachment arms are substantially rectangular and do not extend into said first and second support arms.

* * * * *

UNITED STATES PATENT AND TRADEMARK OFFICE

CERTIFICATE OF CORRECTION

PATENT NO. : 6,111,349

DATED : August 29, 2000

INVENTOR(S) : Yasuhiro Kuwana et al.

It is certified that error appears in the above-identified patent and that said Letters Patent are hereby corrected as shown below:

Specification, Col. 1, line 63, after "interface", delete ---is---.

Claim 1, Col. 6, line 26, change "grill" to ---grille---.

Claim 6, Col. 6, line 49, change "grill" to ---grille---.

Claim 6, Col. 6, line 53, change "traverse" to ---transverse---.

Claim 6, Col. 6, line 62, change "portion" to ---portions---.

Claim 10, Col. 7, line 24, change "traverse" to ---transverse---.

Claim 10, Col. 7, line 33, change "portion" to ---portions---.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*